United States Patent [19]

Beuzelin et al.

[11] Patent Number: 4,892,620

[45] Date of Patent: Jan. 9, 1990

[54] DIURETHANE LATEX AND PROCESSES

[75] Inventors: Catherine Beuzelin, Paris; Claude Senez, Gouvieux, both of France

[73] Assignee: Atochem, Paris La Defense, France

[21] Appl. No.: 230,934

[22] Filed: Aug. 8, 1988

Related U.S. Application Data

[62] Division of Ser. No. 3,790, Jan. 16, 1987, Pat. No. 4,786,330.

[30] Foreign Application Priority Data

Jan. 24, 1986 [FR] France ..... 86 00997

[51] Int. Cl.[4] ..... D21H 3/12

[52] U.S. Cl. ..... 162/158; 162/135; 162/164.6; 162/168.2; 427/391; 427/395

[58] Field of Search ..... 162/158, 164.6, 168.2, 162/135; 427/391, 395

[56] References Cited

FOREIGN PATENT DOCUMENTS 2537653 2/1977 Fed. Rep. of Germany ... 162/164.6

*Primary Examiner*—Peter Chin

*Attorney, Agent, or Firm*—Sigalos, Levine & Montgomery

[57] ABSTRACT

A sizing agent for paper consisting essentially of a latex consisting essentially of at least one diurethane dispersed in an aqueous medium, said diurethane being of the formula:

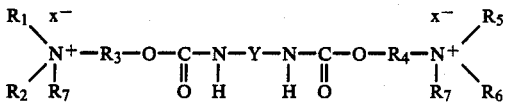

in which:

(a) $R_1$, $R_2$, $R_5$ and $R_6$ are each alkyl radicals and at least one of them possesses a minimum of 7 carbon atoms;

(b) $R_7$ and x represent, respectively, the cationic and anionic portions of the quaternizing agent $R_7x$;

(c) $R_3$ and $R_4$ are selected from $C_2$-$C_4$ alkylene radicals or polyalkoxylated radicals of a degree of polycondensation of between 1 and 4; and (d) Y is

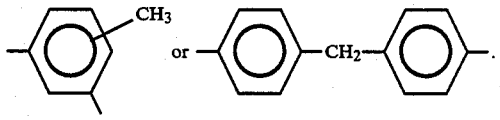

The process of making the sizing agent and using it to size paper are also disclosed.

8 Claims, No Drawings

DIURETHANE LATEX AND PROCESSES

This application is a division of application Ser. No. 003,790, filed Jan. 16, 1987, now U.S. Pat. No. 4,786,330.

BACKGROUND OF THE INVENTION

The present invention concerns a new agent for sizing in the paper industry, more particularly of paper and cartons, consisting of a cationic diurethane dispersed in an aqueous medium in the form of latex, and the process of preparation thereof and of sizing paper therewith.

Cationic urethanes, utilized as sizing agents for the paper industry, are already the object of patents. We are always dealing with cationic polyurethanes or oligourethanes. It is, for instance, known to prepare a quaternary ammonium compound, from a prepolymer with an NCO end group, obtained by the addition of a polyisocyanate to an aliphatic monomer dihydroxylated compound, extended by an aliphatic diol containing a salifiable and/or quaternizable tertiary nitrogen atom. This is the case, for instance, in French Patent No. 2,256,937.

Described in French Patent No. 2,322,236 are cationic polyurethanes that are reaction products of polyisocyanates of the diphenylmethane series containing $C_5$–$C_{12}$ N-alkyldialkanolamines with a $C_1$–$C_6$ alkyl chain and possibly with reactive groups serving as chain breaker, and polyurethanes carrying protonized and/or quaternized ammonium groups, in solution in water and used for paper sizing. These products, having a low molecular weight and although hydrophilic, are recognized by their inventors as being effective, as compared to the previously known cationic products for paper sizing.

SUMMARY OF THE INVENTION

According to this invention, it has been found that shorter molecules; namely, diurethanes, utilized in the form of latex, are particularly effective for the tub sizing of paper; sizing in bulk. The sizing of paper in bulk consists of incorporating, during the formation of the sheet, organic products destined to reduce; indeed, eliminate, the hydrophilic nature of the papers in order to render them suitable for imprinting and writing.

Briefly, the present invention comprises a sizing agent for paper consisting essentially of a latex consisting essentially of at least one diurethane dispersed in an aqueous medium, said diurethane being of the formula:

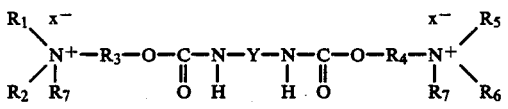

in which:

(a) $R_1$, $R_2$, $R_5$ and $R_6$ are each alkyl radicals and at least one of them possesses a minimum of 7 carbon atoms;

(b) $R_7$ and x represent, respectively, the cationic and anionic portions of the quaternizing agent $R_7x$;

(c) $R_3$ and $R_4$ are selected from $C_2$–$C_4$ alkylene radicals or polyalkoxylated radicals of a degree of polycondensation of between 1 and 4; and (d) Y is

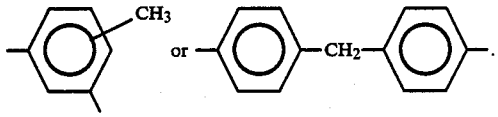

The invention also comprises a process of obtaining these latexes from toluene diisocyanate or diphenylmethane diisocyanate and N-dialkylalkanolamines as hereinafter described.

Further, the invention also comprises a process for the sizing of papers characterized by the fact that these sizing products can be used in neutral medium. It is understood that the term "sizing" includes tub sizing (sizing in bulk; adding of the sizing directly to the stock as a beater additive to produce internal sizing) as well as surface sizing of formed paper or paperstock sheets.

DETAILED DESCRIPTION

The diurethanes used according to the invention are reaction products of an organic polyisocyanate, preferably toluene diisocyanate (TDI) or diphenylmethane diisocyanate (MDI), with two dialkylalkanolamines, identical or different, at least one of the alkanolamines being N-substituted by at least one aliphatic chain including at the minimum 7 carbon atoms and preferably at least 14 carbon atoms. These reaction products are converted into cationic diurethanes, containing quaternary ammonium groups, by reaction of the tertiary nitrogen atoms of the N-dialkylalkanolamines with an appropriate quaternizing agent.

The N-dialkylalkanolamine is preferably modified into quaternary ammonium prior to reacting with the polyisocyanate, but the moment of quaternization of the tertiary N-dialkylalkanolamine is not involved at all in the level of effectiveness of the diurethane as sizing agent for the paper. The degree of quaternization is such that the diurethane can be autodispersible, without however impairing the hydropholic capability of the product.

The products of the invention thus are cationic diurethanes, possessing a hydropholic capability, dispersible in water, in order to form stable latexes capable of becoming adsorbed on the cellulosic fibers and thus utilizable for paper sizing.

For the preparation of these diurethanes, one utilizes as polyisocyanates the toluene-2,4 diisocyanate, or toluene-2,6 diisocyanate, as well as their mixture (TDI) and diphenylmethane diisocyanate (MDI).

As used herein, "N-dialkylalkanolamine" means organic compounds containing two aliphatic chains each connected to the nitrogen atom and a hydroxy group likewise connected to the nitrogen atom by a linear or branched aliphatic chain comprising 2 to 4 carbon atoms, or by a polyalkoxylated chain of a degree of polycondensation between 1 and 4.

With two N-dialkylalkanolamines being used according to the invention, it is necessary for at least one of the two aliphatic chains of at least one of th4ese N-dialkylalkanolamines not to be too short, since it is not possible under the conditions of the invention, by the reaction of two N-dialkylalkanolamines having short chains with the TDI or the MDI to obtain efficient latexes for paper sizing, according to the operating procedure described below. It is, however, not excluded to use the same N-dialkylalkanolamine possessing at least one aliphatic chain containing a minimum of $C_7$.

Within the scope of the invention, it is preferable to put the tertiary N-dialkylalkanolamine into the quaternized form prior to its reaction with the TDI or MDI. Nevertheless, it is possible to convert the tertiary amine into quaternary ammonium after, or even during, the formation of the diurethane. The quaternizing agents which are suitable are in principle all quaternizing substances. We shall preferably cite compounds containing an activated halogen atom such as, for instance, methylchloride, bromide or iodide, benzyl chloride, allyl chloride, or yet epichlorohydrin or active esters like, for instance, dimethyl sulfate.

The cationic diurethanes used according to the invention can be written in the following manner:

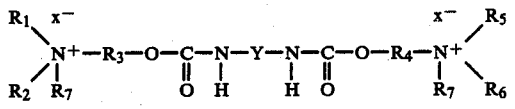

in which:

$R_1$, $R_2$, $R_5$ and $R_6$ are each alkyl radicals and at least one of them possesses a minimum of 7 carbon atoms;

$R_7$ and x represent, respectively, the cationic and anionic portions of the quaternizing agent $R_7x$;

$R_3$ and $R_4$ are selected from among linear or branched alkylene radicals containing $C_2$ to $C_4$ preferably of the formula:

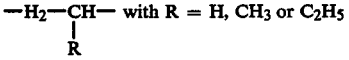

or yet polyalkoxylated radicals of a degree of polycondensation between 1 and 4 and preferably of the formula:

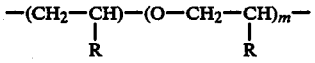

with R=H, $CH_3$ or $C_2H_5$ and $1 \leqq m \leqq 3$, $-y$ represents one of the following two aryl groups:

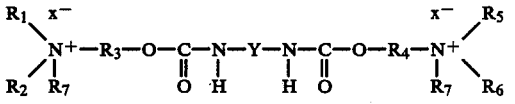

The reaction of the polyisocyanate; preferably, TDI or MDI, with the N-dialkylalkanolamine or N-dialkylalkanolamines possibly quaternized, can take place in the solvent phase, or in the absence of solvent, depending on the nature of the diurethane, symmetrical or asymmetrical, desired. When the reaction takes place in organic solvent medium, the solvents used must not contain active hydrogen atoms capable of reacting with the isocyanate groups. The solvents employed must likewise have a boiling point which is not very high, so that they can easily be eliminated from the final latex. These solvents must, moreover, facilitate the dispersion of the dimer in the water. Methylene chloride ($CH_2Cl_2$) and ethyl acetate ($CH_3CO_2CH_2CH_3$), used in such quantities that the diurethane obtained has a dry extract between 20 and 60%, are two of the preferred solvents.

The reaction can be accelerated with the help of various catalysts such as the organometallic compounds such as stannous octanoate, lead octanoate, or dibutyl tin dilaurate.

The quaternization of the N-dialkylalkanolamine is carried out between 25° C. and 100° C. by an approapriate quaternizing agent as defined previously. The degree of quaternization is preferably between 10 and 50% with respect to the quaternizable nitrogen atoms. Too high degree of quaternization hurts the effectiveness of the final product since it contributes to exaggerating its hydrophilic character. Too low a degree of quaternization does not permit dispersing the addition product correctly. It is noted that dimethyl sulfate is one of the most appropriate quaternizing agents inasmuch as its action is very rapid.

The partially quaternized final diurethane can be obtained from a mixture of two diurethanes, one partially cationized or not cationized, the other partially or 100% quaternized, in such a ratio that the desired final quaternization degree is obtained. It is likewise possible to directly obtain the desired degree of cationic activity by quaternizing the number of necessary tertiary nitrogen atoms of the N-alkylalkanolamine or N-alkylalkanolamines.

They summetrical diurethane carrying quaternized nitrogen atoms is generally obtained under agitation by the progressive addition of TDI or MDI to quaternized N-dialkylalkanolamine diluted or not in an organic solvent, in the presence or not of a catalyst. In the case in which an organic solvent is employed, the dilution is such that one obtains a dry extract of diurethane between 20 and 75%; since the addition reaction is exothermic, the temperature is limited by the reflux of the solvent.

The asymmetrical diurethane is more generally obtained, under agitation, by the slow addition of one of the two dialkylalkanolamines, diluted in an organic solvent, to the polyisocyanate, preferably in an organic solvent medium. Subsequently, the other dialkylalkanolamine is added more rapidly.

When the final diurethane is obtained by mixing two diurethanes; for instance, one slightly or not quaternized and the other one highly or 100% cationic, it is preferable to work in a solvent medium to achieve the synthesis of the two diurethanes.

In the case in which the desired degree of cationicity is obtained by the direct quaternization of the tertiary nitrogen atoms, it is not necessary to work in a solvent medium, provided that this degree of cationicity does not exceed 30%.

After obtaining the diurethane, the organic solution of cationic diurethane is emulsified in water. In the case in which the cationic synthesis has been achieved in the absence of a solvent, the cationic diurethane is advantageously diluted in an appropriate solvent, such as methylene chloride or ethyl acetate, in such a way as to have a dry extract of between 20 and 60%. The emulsification in water of the diurethane, in solution in the solvent, is facilitated by the use of a third solvent. This solvent has as its goal to homogenize the combination of the three constituents of the mixture: the diurethane, the solvent of solubilization, and the water. For instance, the association of acetone with methylene chloride, two solvents whose behavior is totally opposite with respect to water, favors obtaining fine and stable dispersions.

The quantity of a third solvent necessary for the optimization of the fineness (particle size) of the dispersion is a function of the quantity of solvent in which the diurethane is solubilized. In the case, for instance, of the pair of acetone-methylene chloride, there exists an interval of values of the mass ratio of acetone/methylene chloride outside of which; after emulsifying the system and evaporation of the two solvents, one obtains aqueous dispersions of cationic diurethanes whose particle size is above 0.4 μm, sooner or later leading to sedimentation phenomena. The quantity of water necessary for placement in dispersion must be greater than a certain threshold, determined for the total quantity of the solvents, below which it is impossible to obtain a stable and effective latex. The most suitable quantity can be determined by routine experimentation.

The mixture of the aqueous phase and the organic phase, in the presence of a third solvent, can be obtained by means of a standard mixing device of high shearing power and allowing working under high pressures.

Industrially, one preferably proceeds in the following manner: the diurethane previously dissolved in an appropriate organic medium; ethyl acetate, being one of the preferred solvents, is placed in an aqueous emulsion by means of a homogenizer; the use of a third solvent is not excluded. The solvent or solvents are then eliminated by distillation.

Depending on the process, one obtains cationic diurethane latexes with content values of solids varying from 7 to 30% by weight. The dimension of the particles in general does not exceed 0.2 μm, conferring an excellent stability on the latex.

Another interesting point resides in the possibility of using latexes obtained in neutral medium, at a pH between 6 and 9, thus avoiding the numerous disadvantages of standard sizings in acid medium. They can be used with all of the usual additives used conventionally in the paper industry to prepare paper.

As used herein, "paper" means paper and paperboard stock customarily sized in the paper industry in making writing paper, cartons, and the like.

In the examples which follow, which are given only for purposes of further description of the invention, the parts are by weight unless expressly stated to the contrary. The placement in aqueous dispersion of the diurethane, after possible solution in a solvent, is achieved by means of either an ultrasonic vibration or a homogenizer with strong shearing action functioning under a pressure of 400 to 700 bars.

EXAMPLE 1

238.5 parts of N-distearylethanolamine and 238 parts of methylene chloride are introduced into a reactor topped by cooling means and provided with an agitating device. The temperature of the mixture is raised to 30° C. and 36 parts of toluene diisocyanate diluted in 36 parts of methylene chloride are then poured in progressively under agitation. The reaction mixture heats up. The rate of introduction of the TDI is such that that the reflux of the solvent can be kept uniform. One thus obtains a non-cationic diurethane having 50% of dry matter (solids) in the methylene chloride.

126.7 parts of N-distearylethanolamine and 27.8 parts of dimethyl sulfate are introduced into a second reactor equipped with the same devices as previously. The temperature of the reaction medium rises up to about 100° C. The quaternization is terminated at the end of the exothermic rise. One then leaves the mixture under agitation until the temperature of the system has returned to about 30° C. The N-distearylethanolamine, cationized at 100% with respect to the tertiary amines, is then diluted in 157 parts of methylene chloride and 19 parts of TDI diluted in 19 parts of $CH_2Cl_2$ are introduced progrressively, still under agitation. One thus obtains a 100% cationic diurethane, having 50% of dry matter in the methylene chloride.

324.6 parts of the organic solution of the non-quarternized diurethane is added to 80 parts of the 100% cationic diurethane. One thus obtains a cationic diurethane with 50% solids in the methylene chloride, possessing a degree of quaternization of 15%.

Fabrication of the latex 50 parts of acetone are added to 25 parts of the organic solution of the previously prepared diurethane quaternized at 15%. 150 parts of water are then added and the mixture is emulsified with the help of an ultrasonic agitator. The methylene chloride and the acetone are then eliminated by distillation. One obtains a latex at 10% by weight of solids, whose particle dimension amounts to 0.15 μm.

EXAMPLE 2

Direct quaternization of the amine 367.5 parts of N-distearylethanol amine and 16.4 parts of dimethyl sulfate are introduced into a reactor topped by cooling means and equipped with an agitation device. The partially quaternized amine is then diluted in 385 parts of methylene chloride. One then introduces 132 parts of a solution of methylene chloride containing 50% of toluene diisocyanate. The cationic diurethane obtained has 50% solids in the methylene chloride and possesses a degree of quaternization of 20%.

Fabrication of the latex 30 parts of this solution of diurethane in methylene chloride are mixed with 70 parts of acetone, then emulsified in 150 parts of water, with an ultrasonic agitator.

The solvents are then eliminated by distillation. One obtains a latex whose solids content is 9.2% by weight and whose particle dimension is 0.15 μm.

EXAMPLE 3

330 parts of acetone are added to 150 parts of the solution of diurethane in methylene chloride prepared in Example 2. This mixture is then emulsified in 900 parts of water, with the help of a homogenizer. The two solvents are then eliminated by distillation. A latex is obtained whose solids content is 7.8% by weight and whose particle dimension is 0.20 μm.

EXAMPLE 4

By using the same installation and the same manner of proceeding as in Example 2, 2.52 parts of dimethyl sulfate are added to 123.8 parts of twice ethoxylated distearylamine. After the dilution of this amine quaternized at 10% in 225 parts of methylene chloride, one introduces 83 parts of a solution of methylene chloride containing 30% by weight of diphenylmethanediisocyanate.

92 parts of acetone are added to 55 parts of this solution of cationic diurethane. The mixture is then emulsified in 210 parts of water, with an ultrasonic agitator. After elimination of the solvents, one obtains a latex whose solids content is 9.5% by weight and whose particle dimension is 0.12 μm.

EXAMPLE 5

By employing the same installation as in Example 2, 216 parts of a solution of $CH_3CO_2C_2H_5$ containing 35% by weight of methylstearylaminomethyl-1-ethanol quaternized at 17% are added very slowly to 71 parts of a solution of ethyl acetate containing 55% by weight of toluene diisocyanate. Then 94.1 parts of didodecylethanolamine possessing the same degree of cationicity as the first disubstituted alkanolamine, diluted in 120 parts of ethyl acetate, are introduced more rapidly.

135 parts of the solution of cationic diurethane prepared previously are emulsified in 450 parts of water, by employing a homogenizer. The solvent is then evaporated. One obtains a latex whose dry matter (solids) content is 11.5% by weight and whose particle dimension is 0.16 μm.

EXAMPLE 6

One operates according to Example 2, but replacing the distearylethanolamine by a dialkylethanolamine derived from coconut oil and possessing fatty chains containing $C_{10}$ (10%), $C_{12}$ (45%), $C_{14}$ (16–20%), $C_{16}$ (10–20%), and $C_{18}$ (15%).

108.3 parts of a solution of methylene chloride containing 26% by weight of toluene diisocyanate are added dropwise to 156.9 parts of this amine quaternized at 20% and diluted in 100 parts of methylene chloride.

55 parts of acetone are added to 25 parts of this solution of cationic diurethane. The mixture is emulsified in 150 parts of water, with an ultrasonic agitator. After elimination of the solvents, the latex contains 8.7% by weight of dry matter and the dimension of its particles is 0.13 μm.

EXAMPLE 7

90 parts of foluene diisocyanate are added dropwise to 572.5 parts of a distearylethanolamine quaternized at 15% by methyl chloride.

When the reaction of dimerization is terminated, the product is placed in aqueous dispersion, in the absence of solvent, with the help of a homogenizer. A latex is obtained whose dry matter content is 12.3% by weight and whose particle dimension is 0.3 μm.

EXAMPLE 8

6.3 parts of dimethyl sulfate are added to 141.2 parts of once ethoxylated distearylamine. 22.5 parts of toluene diisocyanate are then added.

37.5 parts of ethyl acetate are added to 25 parts of diurethane. 180 parts of water are then added and the mixture is emulsified with the help of an ultrasonic agitator. After elimination of solvents by distillation, one obtains a latex of diurethane quaternized at 20% whose dry matter content is 11.8% by weight and whose particle dimension is 0.14 μm.

EXAMPLE 9

125 parts of diphenylmethane diisocyanate are added to 380 parts of twice ethoxylated methylstearylamine quaternized at 10% by methyl chloride.

50 parts of ethyl acetate are added to 40 parts of cationic diurethane thus obtained. This mixture is then emulsified in 300 parts of water, with the help of a homogenizer. After elimination of the solvent by distillation, one obtains a latex whose dry material content is 11.3% by weight and whose particle dimension is 0.1 μm.

EXAMPLE 10

92 parts of toluene diisocyanate are added to 346 parts of methylstearylethanolamine quaternized at 15% by dimethyl sulfate.

When the dimerization reaction is terminated, the product is placed in aqueous dispersion, in the absence of solvent, with the help of a homogenizer. One obtains a latex whose dry matter content is 12.3% by weight and whose particle dimension is 0.35 μm.

APPLICATION TESTS

For the study of the sizing properties of the paper relative to the latexes prepared in the above examples, the COBB coefficient is determined in conformity with AFNOR standard Q 03.018. According to this standard, one determines the quantity of water which a paper or a carton can absorb in a given time. The weight of water retained per surface unit during a fixed duration of time is measured. The slighter the water absorption, the better is the effect of sizing. The determination of the COBB coefficient takes place on a circular sample of a surface of 100 $cm^2$. The time of contact between the water and the paper sample is 50 seconds ($COBB_{60}$).

In all of the application tests presented below, the ratio of sizing agent is given in weight percentage of active substance in relation to the dry pulp.

Two series of tests (Tests No. 1 to 6 and Tests No. 7 to 14) were carried out in order to determine the properties of the latexes prepared in the previous examples and used as sizing agents of paper in the tub, in neutral medium.

According to tests No. 1 to 6, a paper of 65 $g/m^2$ is prepared under conditions similar to an industrial fabrication, from a cellulose pulp with long fibers bleached and refined to 24°SR, to which the sizing agent is added at different ratios. Paper fillers such as calcium carbonate and retention agents are possibly introduced into the pulp. Small paper forms are obtained on the laboratory machine, known under the name of "Franck forms", dried under vacuum at 90° C. for 5 minutes, then passed through the drying oven for 45 min. at 130° C. The determination of the $COBB_{60}$ coefficient is carried out 3 hours after placement into ambient atmosphere. The special conditions of each test are given below.

TEST NO. 1

The latex, prepared according to the procedure of Example 1, is introduced into the pulp diluted in demineralized water (8 g of cellulose per liter of water), in the absence of any paper filler, at a quantity of 0.5% by weight of dry diurethane with respect to the dry pulp.

TEXT NO. 2

Into the diluted pulp containing 6.4 g of cellulose and 1.6 g of calcium carbonate per liter of water, the latex, prepared according to the procedure of Example 1, is introduced in an amount of 0.8% of dry diurethane with respect to the dry pulp. A cationic starch (corn wax) is likewise added at a dose of 0.3%, still based on the dry pulp.

TEST NO. 3

Into the diluted pulp containing 6.4 g of cellulose and 1.6 g of calcium carbonate per liter of water, the latex, prepared according to the procedure of Example 2, is introduced in an amount of 0.3% of dry diurethane with respect to the dry pulp, as well as a cationic starch at a dose of 0.3% and a moderately cationic polyacrylamide, used conventionally in the paper industry, in an amount of 0.03%.

TEST NO. 4

Into the same pulp composition as in the preceding test, one introduces the latex prepared according to the procedure of Example 4, in an amount of 0.5% of dry diurethane with respect to the dry pulp, as well as a starch and a polyacrylamide, both cationic, respectively, in amounts of 0.25% and 0.04% with respect to the dry pulp.

TEST NO. 5

Into a diluted pulp having the same composition as the one of test No. 3, 0.8% of latex prepared according to the procedure of Example 5 are introduced, as well as the two retention agents used in Test No. 3, in an amount of 0.3% and 0.03%, respectively.

TEST NO. 6

Into diluted pulp having the same composition as that of Test No. 5, one introduces the latex prepared according to the procedure of Example 6, in an amount of 1% of dry diurethane with respect to the dry pulp, as well as a cationic corn wax at a does of 0.28% and a modified polyacrylamide at a does of 0.03%.

The results of Tests 1 to 6 are summarized in Table I below:

TABLE I

| Test No. | Sizing agent (reference of the Example of the latex utilized) | Proportion of sizing agent (%) | $COBB_{60}$ ($g/m^2$) |
|---|---|---|---|
| 1 | 1 | 0.5 | 19.3 |
| 2 | 1 | 0.8 | 15.7 |
| 3 | 2 | 0.3 | 18.7 |
| 4 | 4 | 0.5 | 16.3 |
| 5 | 5 | 0.8 | 20.8 |
| 6 | 6 | 1 | 21.9 |

In Tests 7 to 14, a paper of 70 $g/m^2$ is prepared on a laboratory machine which is a reproduction of a reduced scale of an industrial machine of standard type, whose drying section comprises a pre-drying system of 16 dryers, a size-press and a post-drying system of 6 dryers. Said paper is prepared from a cellulose pulp which is white and refined to 30° SR, comprising 65% by weight of a short fiber cellulose and 35% by weight of a long fiber cellulose. To this pulp, one adds calcium carbonate in a proportion of 25% by weight with respect to the total amount of pulp, the sizing product in different proportions and two cationic retention agents, one a corn starch, the other a polyacrylamide, at respective proportions of 0.3 and 0.03% by weight with respect to the total amount of pulp. Three $COBB_{60}$ determinations are carried out:

(i) on a sample taken just before the paper enters into the size press; determination carried out immediately after taking the sample, (ii) and (iii) on a sample taken just after the paper comes out of the machine with determinations carried out immediately and 48 hours after taking the sample.

The results are summarized in Table II below:

TABLE II

| Test No. | Sizing agent (refernce of the example of latex used) | Proportion of sizing agent (%) | $COBB_{60}$ ($g/m^2$) Before entry size press immediate determination | After coming out of the machine immediate determination | After coming out of the machine determination after 48 hrs. |
|---|---|---|---|---|---|
| 7 | 10 | 0.2 | 39 | 32 | 26.7 |
| 8 | 9 | 0.4 | 36.5 | 29.2 | 25.8 |
| 9 | 4 | 0.3 | 39 | 30.3 | 21.3 |
| 10 | 8 | 0.2 | 31 | 25.8 | 16.6 |
| 11 | 8 | 0.3 | 23.7 | 19.4 | 14.4 |
| 12 | 7 | 0.15 | 42 | 35.3 | 27 |
| 13 | 7 | 0.2 | 28.6 | 24.2 | 17.7 |
| 14 | 8 | 0.4 | 22.4 | 19.2 | 13.2 |

As far as the effect of sizing conferred upon the paper by the sizing agents according to the invention is concerned, one sees that:

(i) two days after the preparation of the paper it is satisfactory in all of the tests carried out and excellent in Tests 10, 11, 13, and 14, at proportions of sizing agent not exceeding 0.4%, (ii) it is already satisfactory as soon as the paper comes out of the machine in Tests 11, 13, and 14 and even excellent in Tests 11 and 14, and (iii) prior to passage of the paper through the size press it is sufficiently high in Tests 11, 13, and 14 in order to permit the industrial use of the size press at proportions of sizing agent not exceeding 0.4%.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process of sizing a paper comprising adding to the paper the sizing agent in an amount sufficient to size the paper and then drying the paper, said sizing agent utilizable in a neutral medium consisting essentially of a latex consisting essentially of at least one diurethane dispersed in an aqueous medium, said diurethane being of the formula:

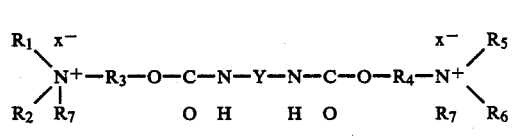

in which:

(a) $R_1$, $R_2$, $R_5$ and $R_6$ are each alkyl radicals and at least one of them possesses a medium of 7 carbon atoms;

(b) $R_7$ and x represent, respectively, the cationic and anionic portions of the quarternizing agent $R_7x$;

(c) $R_3$ and $R_4$ are selected from $C_2$–$C_4$ alkylene radicals or polyalkoxylated radicals of a degree of polycondensation of between 1 and 4; and (d) Y is

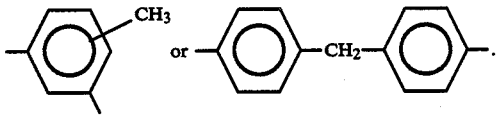

2. The process of claim 1, wherein the sizing agent is added to paper stock and the paper stock then formed into sheets.

3. The process of claim 1, wherein the sizing agent is added to the surface of a paper.

4. The process of claim 1, wherein said alkylene radicals are of the formula:

$$-CH_2-\underset{\underset{R}{|}}{CH}-$$

in which R=H, $CH_3$, or $C_2H_5$.

5. The process of claim 1, wherein said polyalkoxylated radicals are of the formula:

$$-(CH_2-\underset{\underset{R}{|}}{CH})-(O-CH_2-\underset{\underset{R}{|}}{CH})_m-$$

in which R=H, $CH_3$ or $C_2H_5$ and $1 \leqq m \leqq 3$.

6. The process of claim 1, wherein the degree of quaternization of said sizing agent with respect to the quartenizable nitrogen atoms is between about 10 and 50%.

7. The process of claim 1, wherein said latex consists of a mixture of two diurethanes, one being partially cationized or uncationized and the other being partially or 100% quarternized; the proportions of each diurethane in the latex being such that the degree of quaternization of quaternizable nitrogen atoms in the latex is between about 10 to 50%.

8. The process of claim 1, 2, 3, 4, 5, 6, or 7 wherein the sizing agent is added to the paper in a substantially neutral medium.

* * * * *

UNITED STATES PATENT AND TRADEMARK OFFICE

CERTIFICATE OF CORRECTION

PATENT NO. : 4,892,620

DATED : January 9, 1990

INVENTOR(S) : Catherine Beuzelin, et al

It is certified that error appears in the above-indentified patent and that said Letters Patent is hereby corrected as shown below:

Column 10,

In claim 1, line 63, correct the formula

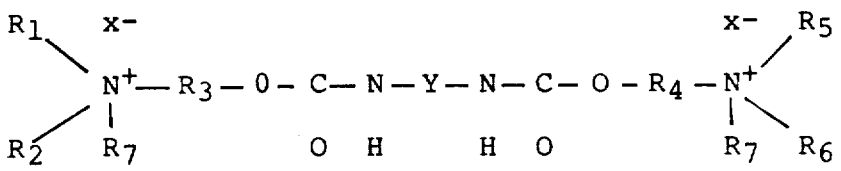

to read

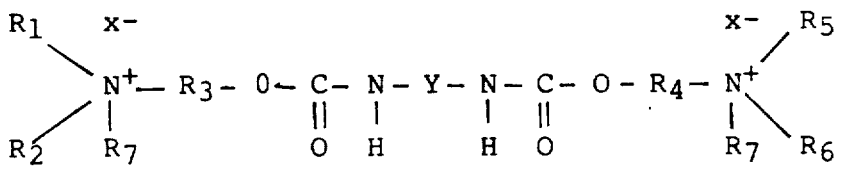

Signed and Sealed this

Twenty-second Day of March, 1994

*Attest:*

BRUCE LEHMAN

*Attesting Officer*

*Commissioner of Patents and Trademarks*